US005885350A

United States Patent [19]

Henninger

[11] Patent Number: 5,885,350

[45] Date of Patent: Mar. 23, 1999

[54] COATING DEVICE FOR WEBS OF PAPER OR BOARD

[75] Inventor: Christoph Henninger, Heidenheim, Germany

[73] Assignee: J.M. Voith GmbH, Heidenheim, Germany

[21] Appl. No.: 798,315

[22] Filed: Feb. 10, 1997

Related U.S. Application Data

[63] Continuation of Ser. No. 958,955, Oct. 9, 1992, abandoned.

[30] Foreign Application Priority Data

Mar. 19, 1992 [DE] Germany ..... 42 08 897.6

[51] Int. Cl.[6] ..... B05C 3/02

[52] U.S. Cl. ..... 118/413; 118/419

[58] Field of Search ..... 118/413, 410, 118/419, 261

[56] References Cited

U.S. PATENT DOCUMENTS

| | | | |
|---|---|---|---|
| 4,387,663 | 6/1983 | Alheid | 118/413 |
| 4,534,309 | 8/1985 | Damrau et al. | 118/410 |
| 4,594,963 | 6/1986 | Krautzberger | 118/410 |
| 4,688,516 | 8/1987 | Sommer | 118/410 |
| 4,757,782 | 7/1988 | Pullinen | 118/411 |
| 4,934,130 | 6/1990 | Wohrle et al. | 118/410 |
| 4,964,364 | 10/1990 | Karna et al. | 118/410 |
| 5,109,792 | 5/1992 | Baldini | 118/410 |
| 5,168,806 | 12/1992 | Reder et al. | 118/410 |

FOREIGN PATENT DOCUMENTS

| | | | |
|---|---|---|---|
| 2174625 | 11/1986 | United Kingdom | 118/410 |

*Primary Examiner*—Brenda A. Lamb
*Attorney, Agent, or Firm*—Baker & Daniels

[57] ABSTRACT

The invention concerns an applicator mechanism for the coating of running webs of paper or cardboard, with an applicator chamber which carries at least 0.01 bar of pressure, is formed on a roll and defined in running direction by a doctor element on the trailing side of the coating chamber with respect to the direction of movement of the outer surface of the web or roll, and a barrier wall disposed at the leading side of the coating chamber with respect to the movement of the outer surface of the roll or web. The barrier wall of the inventive coating applicator includes a foil type or band type blocking element which is resilient in at least one area, or is fashioned as a flexibly retained plate or slat whose chord extends between its free end edge and its mounting backing line, on the backing element and against the inside pressure of the chamber, while at its currently prevailing pattern forming a narrow variable gap with the outer surface of the roll or web, which gap also may approach zero or amount to zero, is arranged at an angle to the surface of the roll or web of between 70° and 105°.

15 Claims, 2 Drawing Sheets

COATING DEVICE FOR WEBS OF PAPER OR BOARD

This is a continuation of application Ser. No. 07/958,955, filed Oct. 9, 1992 now abandoned.

BACKGROUND OF THE INVENTION

The present invention relates to a coating device for webs of paper or board having a coating chamber, doctor element and barrier wall. Such a device has been proposed in U.S. Pat. No. 4,688,516. In accordance with FIG. 1 of this publication a strip spring-like barrier element wipes against the web of material, for which purpose it forms a small angle of at the most 32°. This device is however unsatisfactory since there is excessive abrasion of the paper or the barrier elements itself. Furthermore an extremely complex structure of the entire device adjacent to this barrier element is called for to enable excess coating material to leave the coating chamber.

SUMMARY OF THE INVENTION

One object of the invention is to prevent a chafing or abrasive effect of a barrier element on the opposite roll or on the web and to design the entire device in a relatively simple manner and furthermore to minimize damage when commencing coating, while there is a minimum rate of overflow through the gap between the barrier element and the opposite roll or web, when the gap is relatively narrow.

The present invention provides a barrier wall having at least one part thereof which is movable. The movable part is resilient and includes an extension or chord which, when in a relaxed position, forms an angle with a line drawn tangent to the roll at a point of intersection with such extension or chord of between 70° and 110° inside the chamber. The movable part and the roll define a variable gap therebetween which may approximate to zero.

Owing to this particular arrangement of the resilient or resiliently held or resiliently mounted barrier element there is the effect that with an increase in gage pressure in the coating chamber the gap formed between the free end edge of the barrier element and the web, or respectively, the roll immediately increases in size so that an increased rate of flow of excess coating material will emerge through the gap from the coating chamber and therefore prevent an excessive increase in the gage pressure in the same.

In this respect it is more particularly significant that the angle between the barrier element, which is preferably in the form of a strip spring, and the tangent on the same drawn in the gap between it adjacent to web or roll, measured to the inside of the coating material chamber, is between 95° and 70° and preferably between 88° and 75°. This means that when pressure in the coating chamber increases, the barrier element immediately gives way and there is a distinct increase in size of the gap so that barrier element is particularly effective. Since the barrier element is in the form of an extremely thin strip spring, with a thickness between 0.3 and 0.8 mm, significant damage or other impairment to the web or the roll when commencing coating is not likely. The barrier element can then move out of the way, for instance when there is a pile up of paper adjacent to it as may be caused by tearing of the web.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

The parts illustrated in the sections naturally all extend essentially along the longitudinal axis of the roll and along the full length thereof at least for the maximum breadth of the web of paper or board. The same naturally also goes for the fold line also referred to hereinafter as the hump or bend line, to be described later, in the barrier element, if it is designed in the form of a continuous strip spring, or, respectively, for both for its resilient components and also for the gap s between the free end edge of the barrier element and the roll W or, respectively, the running web.

Figure 1:
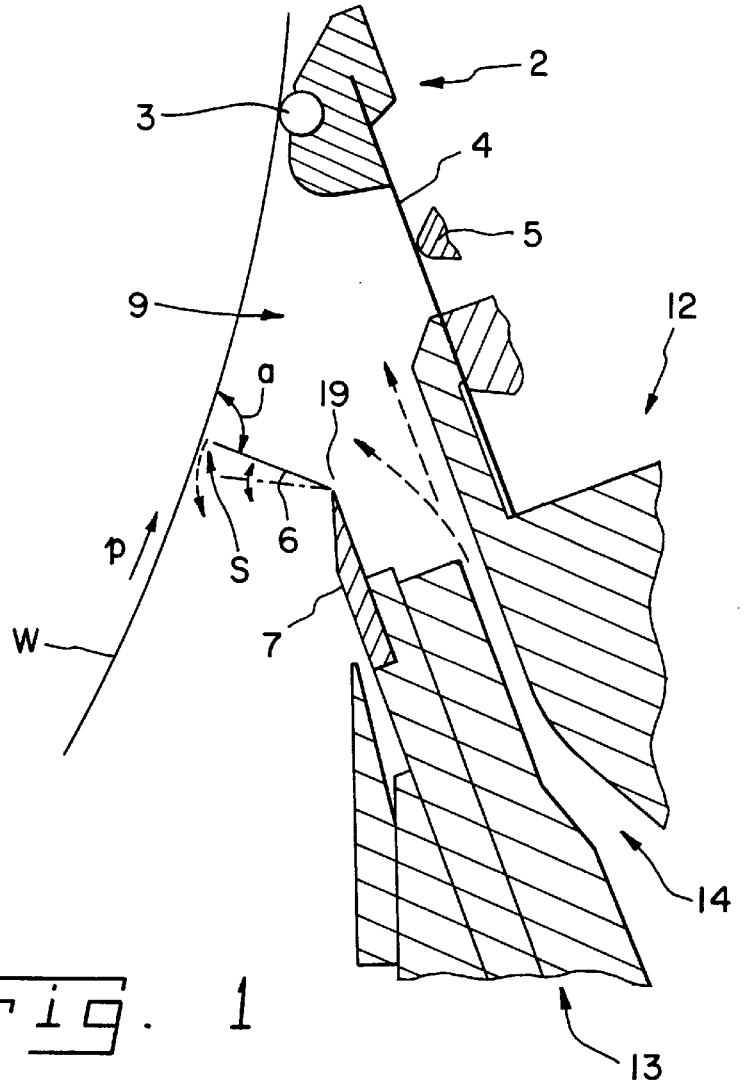
FIG. 1 is a cross section taken through a coating device in accordance with the invention to show the main features thereof.

FIG. 1 shows a coating device, which is frequently referred to as a jet coating device and accordingly has a jet duct 14 for the supply of the coating material to a reservoir, generally provided on a support beam of the coating device, and thence to the coating chamber 9, which is formed on the web of material and is delimited by a doctor element 2—on moving web or, respectively, the outer surface of the roll—on the trailing side and by a resilient element 6 on the leading side (see arrow P for the direction of movement of the web or the roll casing W). The doctor element 2 in this case preferably has a metering bar 3 in the form of a cylindrical rod. The same may have circumferential grooves to be driven in the opposite direction to the web or, respectively, the roll as is conventional. This so-called roll doctor rod is held in a synthetic resin bed, which for its part is anchored by means of a sheet-like holder 4 in the holding means of a main support beam 12 for the coating device. By means of a thrust element (as for instance a pressure hose) 5 only indicated generally, it is possible for doctor rod 3 to be urged against the web or the roll. On the leading side a gap s is provided between the free end edge of barrier element 6 and the web, or respectively, the roll W. Gap s functions to remove excess coating material from coating chamber 9, it having to be noted that a certain substantial excess is always necessary for satisfactorily coating the product. As a metering bar it is furthermore possible to utilize a conventional blade.

In this case resilient element 6 is constituted by a strip spring, which is made with an angle along a bent edge 19 and at this edge is supported by bar-like or plate-like support 7 to resist the internal pressure in coating chamber 9. In this case barrier element 6 is clamped between support wall 7 and front wall 13 of jet duct 14. It is naturally possible as well to utilize other possibilities of attachment. The barrier element 6 has a free end with a length of between 20 and 100 mm, preferably between 20 and 60 mm, and more preferably at least 30 mm. An angle a between barrier element 6 at its free end and a line drawn tangent to the roll in gap s of the roll is equal to between 70° and 100°, as measured in the interior of coating chamber 9, and preferably between 75° and 88°. This ensures that even in the case of a minor rise in the gage pressure in coating chamber 9 barrier element 6 is able to give way outward and consequently increases gap s with a concomitant reduction in gage pressure in the coating chamber 9. For example, in one embodiment, the free end of barrier element 6 is deflectable in the vicinity of the roll a distance between 0.3 mm and 5 mm for each change of 0.1 bar in the internal pressure within coating chamber 9. In coating chamber 9 there will generally be a gage pressure of between 0.02 and 0.5 bar. This is furthermore partly dependent on the coating material being utilized, which may be size.

Figure 2:
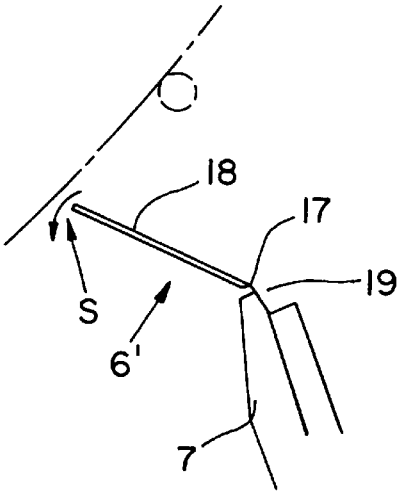
FIGS. 2 to 5 show further possible working embodiments of the barrier element.

The working embodiment illustrated in FIG. 1 is the preferred one. It is naturally possible to adopt certain modifications. In accordance with FIG. 2, the barrier element 6' consists of two parts, that is to say a thin plate or thin strip 18, which is connected with a strip spring-like and correspondingly part that is shorter than in FIG. 1 and is in the form of a strip spring 17 and also has the hump 19' or bend line.

Figure 3:
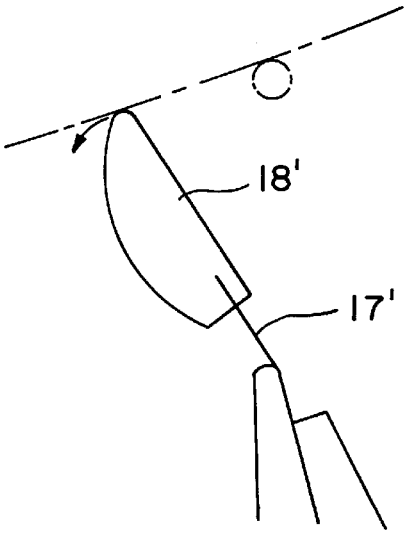

It would also be theoretically possible, in accordance with FIG. 3, to design part 18' adjacent to the roll, in the barrier element as a relatively rigid plate or bar. Remainder 18' defines an extension or chord which is curved. In this case strip spring-like part 17' would then have to bear a relatively large weight. The purpose is to make gap s as small as possible (at the most 2 mm and preferably about 1 mm) so that it is an advantage for the barrier element in the form of a strip spring to be quite thin, that is to say between 0.1 mm and 1.0 in thickness, and preferably between 0.3 mm and 0.8 mm in thickness. This will substantially decrease the danger of damage to the web or to the roll when starting coating thereon.

Figure 4:
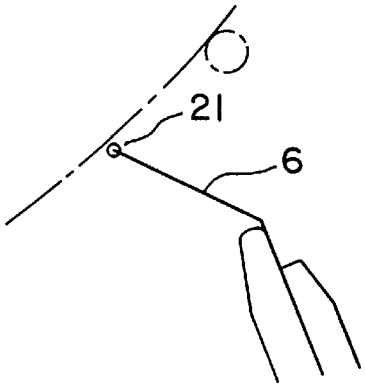

It is an advantage if the inherently free edge of strip spring-like barrier element 6 is coated with a synthetic resin, for instance polyurethane, polyethylene or rubber, having a generally circular cross section, as shown in FIG. 4.

In this case it is possible for the coating part 21 also to abut the web of material or the roll, i.e., with a zero gap.

Figure 5:
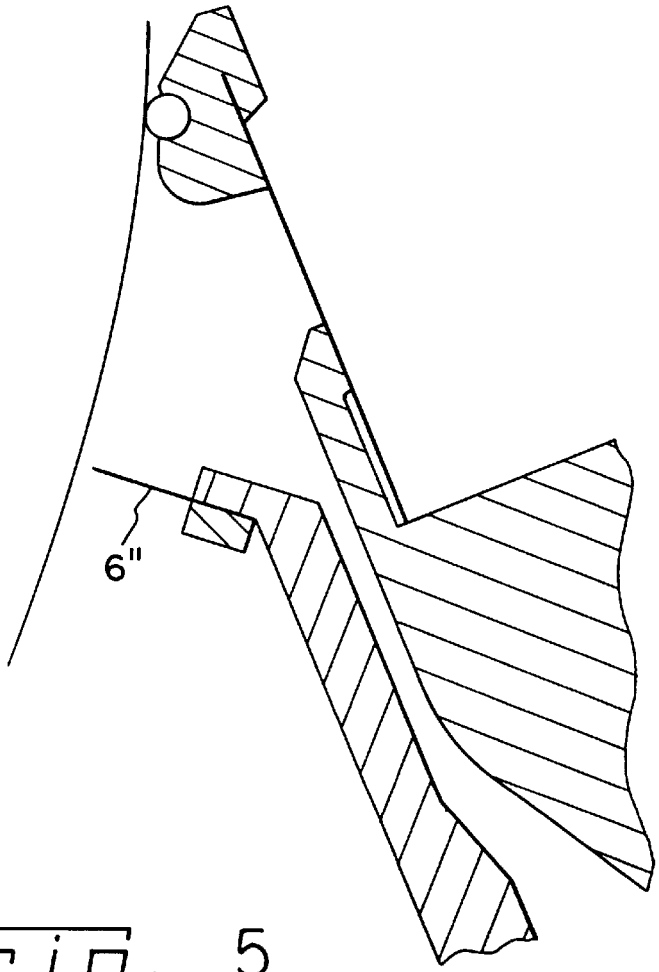

FIG. 5 shows modified design with a straight barrier element 6" in the form of a strip spring.

A further substantial advantage of the illustrated arrangements is that the flexible barrier wall in most cases on or with its holding means (more particularly in operation of the coating device) does not, that is to say does not normally, have to be displaceable, i.e., adjustable, away from the web and toward the roll because there is no lower limit to the size of the gap s and in any case the gap is adjustable, owing to the flexibility of the barrier wall.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A coating device for a moving web of paper or board comprising a coating chamber having an internal gage pressure of at least 0.01 bar above an ambient pressure, said coating chamber defined in part by an outer surface of the web and delimited by a doctor element, said doctor element disposed at the trailing side of said coating chamber with respect to the direction of movement of the outer surface of the web, and a barrier wall disposed at the leading side of said coating chamber with respect to the direction of movement of said outer surface, said barrier wall comprising a barrier element strip having a mounting part and at least one part thereof which is movable, said mounting part and said movable part being connected by a discrete resilient hinge, said movable part being an extension or cord tiltable about said hinge to positions determined by said chamber pressure, when said extension or cord is in a relaxed position, freely extending and unsupported, said extension or cord forms an angle with a line drawn tangent to the roll at a point of intersection with such extension or cord with the web of between 70° and 110° inside the chamber, said movable part and said web defining a variable gap therebetween that is greater than or equal to a distance of zero when said gage pressure within said coating chamber corresponds to a design pressure, said variable gap distance being determined by said tilted position of said extension or cord said extension or cord being deflectable from said relaxed position by said chamber pressure.

2. The coating device of claim 1, wherein said barrier element strip is disposed at an angle between 75° to 88°, as measured in the inside of the coating chamber, to a line drawn tangent to the web in said variable gap, said barrier element having a free end with a length of at least 30 mm adjacent to said variable gap.

3. The coating device of claim 1, wherein said barrier element includes a free end and a free end edge, said free end having a length between 20 and 100 mm.

4. The coating device of claim 3, wherein said barrier element has a constant thickness between 0.1 and 1.0 mm.

5. The coating device of claim 3, wherein said barrier element has a constant thickness between 0.3 and 0.8 mm.

6. The coating device of claim 1, wherein said barrier element includes a free end and a free end edge, said free end having a length between 20 and 60 mm.

7. The coating device of claim 1, wherein said barrier element includes a free end, said free end deflectable nearest the web a distance between 0.3 mm and 5 mm for each change of 0.1 bar in the internal pressure in the coating chamber.

8. The coating device of claim 1, wherein said movable part comprises a resiliently mounted plate or bar.

9. The coating device of claim 1, wherein said extension or chord is curved when said extension or chord is in said relaxed position.

10. A coating device for moving a web of paper or board comprising a coating chamber having an internal gage pressure of at least 0.01 bar above an ambient pressure, said coating chamber defined in part by an outer surface of the web and delimited by a doctor element, said doctor element disposed at the trailing side of said coating chamber with respect to the direction of movement of the outer surface of the web, and a barrier wall disposed at the leading side of said coating chamber with respect to the direction of movement of said outer surface, said barrier wall comprising a barrier element strip having at least one part thereof which is movable, said movable part being resilient and including an extension or cord, when said extension or cord is in a relaxed position, freely extending and unsupported, said extension or cord forms an angle with a line drawn tangent to the web at a point of intersection with such extension or cord with the web of between 70° and 110° inside the chamber, said movable part and said web defining a variable gap therebetween that is greater than or equal to a distance of zero when said gage pressure within said coating chamber corresponds to a design pressure, said extension or cord by deflectable from said relaxed position by said chamber pressure, and a support wall, said barrier element comprising a composite structure consisting of at least two parts, one said composite structure part being a member resiliently connected to said support wall, and another said composite structure part being a relatively rigid plate or bar.

11. A coating device for moving a web of paper or board comprising a coating chamber having a gage pressure of at least 0.01 bar above an ambient pressure, said coating chamber having an outlet end, an intake end and defined in part by the outer surface of the web, said coating chamber delimited by a doctor element at its outlet end, said intake end and said outlet end being defined as intake and outlet ends in relation to the movement of the web, and delimited by a barrier wall at its intake end, said barrier wall comprising a barrier element strip which at least in one part thereof is resilient, said barrier element including a free end edge, said free end edge and said outer surface of the web defining a narrow, variable gap therebetween which is greater than or equal to a distance of zero when said gage pressure within said coating chamber corresponds to a design pressure, said variable gap providing an increasing gap with an increase of the chamber pressure over a design pressure, and a support wall, said barrier element comprising a composite structure consisting of at least two parts, one said composite structure part being a member resiliently connected to said support wall, and another said composite structure part being a relatively rigid plate or bar.

12. A coating device for a moving web of paper or board comprising a coating chamber having an internal gage pressure of at least 0.01 bar above an ambient pressure, said coating chamber defined in part by an outer surface of the web and delimited by a doctor element, said doctor element disposed at the trailing side of said coating chamber with respect to the direction of movement of the outer surface of the web, and a barrier wall disposed at the leading side of said coating chamber with respect to the direction of movement of said outer surface, said barrier wall comprising a barrier element strip having at least one part thereof which is movable, said movable part being resilient and including an extension or cord tiltable to positions determined by said chamber pressure, when said extension or cord is in a relaxed position, freely extending and unsupported, said extension or cord forms an angle with a line drawn tangent to the roll at a point of intersection with such extension or cord with the web of between 70° and 110° inside the chamber, said movable part and said web defining a variable gap therebetween that is greater than or equal to a distance of zero when said gage pressure within said coating chamber corresponds to a design pressure, said variable gap distance being determined by said tilted position of said extension or cord, said extension or cord being deflectable from said relaxed position by said chamber pressure, and said barrier element is clamped at one end thereof and includes a middle part having a partial fold line extending essentially perpendicular to the longitudinal axis of the web said barrier element supported between the position of clamping and the partial fold line to resist the internal pressure of the coating chamber.

13. A coating device for moving a web of paper or board comprising a coating chamber having a gage pressure of at least 0.01 bar above an ambient pressure, said coating chamber having an outlet end, an intake end and defined in part by the outer surface of the web, said coating chamber delimited by a doctor element at its outlet end, said intake end and said outlet end being defined as intake and outlet ends in relation to the movement of the web, and delimited by a barrier wall at its intake end, said barrier wall comprising a barrier element strip which at least in one part thereof is resilient, said barrier element including a free end edge, said free end edge and said outer surface of the web defining a narrow, variable gap therebetween which is greater than or equal to a distance of zero when said gage pressure within said coating chamber corresponds to a design pressure, said variable gap providing an increasing gap with an increase of the chamber pressure over a design pressure and said barrier element is clamped at one end thereof and includes a middle part having a partial fold line extending essentially perpendicular to the longitudinal axis of the web, said barrier element supported between the position of clamping and the partial fold line to resist the internal pressure of the coating chamber.

14. A coating device for moving a web of paper or board comprising a coating chamber having an internal gage pressure of at least 0.01 bar above an ambient pressure, said coating chamber defined in part by an outer surface of the web and delimited by a doctor element, said doctor element disposed at the trailing side of said coating chamber with respect to the direction of movement of the outer surface of the web, and a barrier wall disposed at the leading side of said coating chamber with respect to the direction of movement of said outer surface, said barrier wall comprising a barrier element strip having at least one part thereof which is movable, said movable part being resilient and including an extension or cord, when said extension or cord is in a relaxed position, freely extending and unsupported, said extension or cord forms an angle with a line drawn tangent to the web at a point of intersection with such extension or cord with the web of between 70° and 110° inside the chamber, said movable part and said web defining a variable gap therebetween that is greater than or equal to a distance of zero when said gage pressure within said coating chamber corresponds to a design pressure, said extension or cord being deflectable from said relaxed position by said chamber pressure, said barrier element is clamped at one end thereof and includes a middle part having a partial fold line extending essentially perpendicular to the longitudinal axis of the web, said barrier element supported between the position of clamping and the partial fold line to resist the internal pressure of the coating chamber, and said barrier element clamped end is flexible and a remainder of said barrier element is rigid.

15. A coating device for moving a web of paper or board comprising a coating chamber having an internal gage pressure of at least 0.01 bar above an ambient pressure, said coating chamber defined in part by an outer surface of the web and delimited by a doctor element, said doctor element disposed at the trailing side of said coating chamber with respect to the direction of movement of the outer surface of the web, and a barrier wall disposed at the leading side of said coating chamber with respect to the direction of movement of said outer surface, said barrier wall comprising a barrier element strip having at least one part thereof which is movable, said movable part being resilient and including an extension or cord, when said extension or cord is in a relaxed position, freely extending and unsupported, said extension or cord forms an angle with a line drawn tangent to the roll at a point of intersection with such extension or cord with the web of between 70° and 110° inside the chamber, said movable part and said roll defining a variable gap therebetween that is greater than or equal to a distance of zero when said gage pressure within said coating chamber corresponds to a design pressure, said extension or cord being deflectable from said relaxed position by said chamber pressure, said barrier element is clamped at one end thereof and includes a middle part having a partial fold line extending essentially perpendicular to the longitudinal axis of the web, said barrier element supported between the position of clamping and the partial fold line to resist the internal pressure of the coating chamber, and a portion of said barrier element comprising and adjacent to said partial fold line is flexible and a remaining portion of said barrier element is rigid.

* * * * *